US007252150B2

(12) United States Patent
Downie et al.

(10) Patent No.: US 7,252,150 B2
(45) Date of Patent: Aug. 7, 2007

(54) DOWNHOLE TOOL

(75) Inventors: Andrew McPherson Downie, Fife (GB); Edward Docherty Scott, Fife (GB); Roy Powell, Estes Park, CO (US)

(73) Assignee: Smith International, Inc., Houston, TX (US)

( * ) Notice: Subject to any disclaimer, the term of this patent is extended or adjusted under 35 U.S.C. 154(b) by 0 days.

(21) Appl. No.: 10/798,201

(22) Filed: Mar. 10, 2004
(Under 37 CFR 1.47)

(65) Prior Publication Data

US 2004/0251051 A1 Dec. 16, 2004

Related U.S. Application Data

(63) Continuation of application No. 10/619,402, filed on Jul. 14, 2003, now abandoned, which is a continuation of application No. PCT/GB02/00178, filed on Jan. 15, 2002.

(30) Foreign Application Priority Data

Jan. 15, 2001 (GB) ..... 0101014.9

(51) Int. Cl.
*E21B 17/043* (2006.01)
*E21B 17/06* (2006.01)
*E21B 19/18* (2006.01)
*E21B 23/00* (2006.01)

(52) U.S. Cl. ..... 166/377; 166/237; 166/242.7; 175/101; 175/323; 285/3; 285/91; 285/92; 411/366.3; 411/423

(58) Field of Classification Search ..... 166/242.6, 166/242.7, 237, 377, 98, 104, 117, 117.7; 175/101, 256, 257, 320, 323; 285/81, 91, 285/92, 3, 146, 36, 106, 112, 148, 19, 355, 285/922; 411/411, 423, 366.1, 366.3
See application file for complete search history.

(56) References Cited

U.S. PATENT DOCUMENTS 1,277,624 A * 9/1918 Matula ..... 166/117.7

(Continued)

FOREIGN PATENT DOCUMENTS

GB 2055 927 A 3/1981

*Primary Examiner*—Jennifer H. Gay
(74) *Attorney, Agent, or Firm*—Winston & Strawn LLP

(57) ABSTRACT

A downhole tool including a selectively releasable joint, a downhole drilling assembly including the downhole tool, and a corresponding method. In one embodiment of the invention, a downhole drilling assembly includes a downhole tool having a first body and a second body mounted for relative rotation; a joint part for use in forming a selectively releasable joint between the second body and a part of the assembly coupled to the second body; and one or more locking member(s) for locking the first and second bodies relative to one another against relative rotation so as to allow a release force to be applied through the first body to release the releasable joint and allow the tool to be separated from the part of the assembly.

26 Claims, 6 Drawing Sheets

U.S. PATENT DOCUMENTS

| | | | | | |
|---|---|---|---|---|---|
| 2,033,049 | A | | 10/1936 | Wilkinson | 285/146 |
| 2,204,586 | A | | 6/1940 | Grau | 285/146 |
| 3,732,143 | A | * | 5/1973 | Joosse | 175/6 |
| 3,895,829 | A | * | 7/1975 | Manson, Jr. | 285/3 |
| 4,295,535 | A | * | 10/1981 | Crase et al. | 175/101 |
| 4,452,472 | A | * | 6/1984 | Crase | 285/3 |
| 4,485,880 | A | | 12/1984 | Makohl | 175/107 |
| 4,531,766 | A | * | 7/1985 | Crase | 285/18 |
| 4,641,717 | A | * | 2/1987 | Eppink | 175/74 |
| 4,728,124 | A | * | 3/1988 | Righi et al. | 285/2 |
| 5,029,654 | A | * | 7/1991 | Wilson et al. | 175/74 |
| 5,472,057 | A | * | 12/1995 | Winfree | 175/57 |
| 6,186,249 | B1 | * | 2/2001 | Bjornstad | 175/320 |
| 6,279,962 | B1 | * | 8/2001 | McGarian et al. | 285/12 |
| 6,659,203 | B1 | * | 12/2003 | Cruickshank et al. | 175/107 |
| 2002/0000334 | A1 | * | 1/2002 | Lieser et al. | 175/122 |
| 2002/0179305 | A1 | * | 12/2002 | Mack et al. | 166/377 |
| 2003/0062169 | A1 | * | 4/2003 | Marshall | 166/377 |
| 2004/0011520 | A1 | * | 1/2004 | McGarian et al. | 166/117.7 |
| 2004/0045704 | A1 | * | 3/2004 | Bowles | 166/242.7 |
| 2004/0079555 | A1 | * | 4/2004 | Lange | 175/320 |
| 2004/0188086 | A1 | * | 9/2004 | McGarian et al. | 166/242.6 |
| 2004/0216887 | A1 | * | 11/2004 | Bertelsen | 166/377 |

* cited by examiner

DOWNHOLE TOOL

CROSS-REFERENCE TO RELATED APPLICATIONS

This application is a continuation of application Ser. No. 10/619,402 filed Jul. 14, 2003, now abandoned, which is a continuation of International application PCT/GB02/00178 filed Jan. 15, 2002, the entire content of each which is expressly incorporated herein by reference thereto.

BACKGROUND ART

The present invention relates to a downhole tool capable of forming part of a selectively releasable joint, a downhole drilling assembly that includes that selectively releasable joint and to a method of selectively releasing a part of a downhole drilling assembly from the remainder of the assembly. In particular, the present invention relates to such a tool, assembly and method where a selectively releasable joint is provided which may be released downhole to allow, for example, a drill bit of a drilling assembly to be released from the remainder of the assembly, in the event, for example, that the drill bit becomes stuck during a drilling operation.

In the art of drilling holes in the earth for the purposes of recovering oil and gas accumulations, it is common to use a hydraulic motor to drive the drill bit. In a typical set up a drill bit with a suitable cutting structure is connected to a bottom hole assemblage of drill collars and pipes connected to the surface. The pipes provide a conduit through which a fluid is transmitted to provide hydraulic pressure and flow to the motor. The resultant rotation of the drill bit creates a means for destruction of rock and deepening of the earth bore. In the process of drilling these earth bores it is sometimes possible that the drilling bit becomes stuck in the well bore, for example, due to movements of the rock or other means, thus preventing further deepening of the borehole or preventing extraction of the drilling assembly from the borehole. Under these circumstances it is often necessary to release the drill pipe above the drilling motor and/or any in hole measurement tools, before abandoning or sidetracking the wellbore. This can lead to considerable expense due to the value of the lost equipment and the costs incurred in drilling and recovering the lost wellbore.

The present invention now obviates or at least mitigates at least one of the foregoing disadvantages.

SUMMARY OF THE INVENTION

According to a first aspect of the present invention there is provided a downhole tool for use in a downhole tool assembly, the tool comprising:

a first body and a second body mounted for relative rotation;

a joint part for use in forming a selectively releasable joint between the second body and a part of the assembly couplable to the second body;

locking means for locking the first and second bodies relative to one another against relative rotation, in use, so as to allow a release force to be applied through the first body to release the releasable joint and allow the tool to be separated from the part of the assembly.

This is particularly advantageous in that it may allow the tool to be separated from the part of the assembly at a desired location within the borehole, such that the tool may be recovered to surface. Preferably, the downhole tool assembly comprises a downhole drilling assembly and the downhole tool includes a drilling motor for driving a drill bit of the assembly. Thus, the present invention may particularly advantageously allow a drilling motor and associated assembly to be released and recovered to surface in the event that a drill bit of a drilling assembly including the motor becomes stuck during a drilling operation. It will be understood that this allows the stuck drilling assembly to be released at a point between the drill bit and the downhole motor, significantly reducing costs by allowing the part of the expensive drilling assembly including the drilling motor to be recovered. Furthermore, this may allow the stuck drill bit to be "fished" from the hole and drilling to recommence in the original wellbore, thereby saving the time and cost of plugging and re-drilling a sidetrack borehole.

According to a second aspect of the present invention, there is provided a downhole tool assembly including the downhole tool of the first aspect of the present invention.

According to a third aspect of the present invention, there is provided a downhole drilling assembly comprising:

a downhole drilling motor having a motor body for coupling to tubing of the assembly and a rotatable drive shaft for coupling to a drill bit of the assembly;

a selectively releasable joint located between the drilling motor and the drill bit; and locking means for locking the drive shaft relative to the body of the motor to allow a release force to be applied through the assembly tubing and the motor body to release the releasable joint and allow the drill bit to be separated from a remainder of the drilling assembly.

By this arrangement, the remainder of the assembly may be retrieved in the event that the bit becomes stuck during a drilling operation.

Preferably, the drilling motor comprises a fluid driven motor, such as a turbine driven by, for example, drilling fluids such as a drilling mud. Alternatively, the drilling motor may comprises a positive displacement motor (PDM), an electric motor or any other suitable downhole motor.

The selectively releasable joint may be located between the motor shaft and the drill bit, to allow separation of the drill bit from the remainder of the drilling assembly at a location between the drill bit and the motor shaft. Preferably, the joint is configured to release at a release force which is less than the force applied to "make up" (assemble) the joint for drilling operations. It will be understood that the term "make up", is a term well known in the art, and refers to the making up of, for example, a string of well tubing carrying any desired well tools, such as a drilling assembly, by connecting the various parts together through a series of threaded joints, connected at a desired mating force by applying a corresponding mating torque. Thus, the joint may be configured to release at a release torque less than the torque required to make up the joint. The release torque may be lower than 70% and preferably in the region of 30-50% of the torque required to make up the joint and in particular may be 40% of the torque required to make up the joint. This advantageously allows the releasable joint to be released, following locking of the drive shaft relative to the body of the motor, by "backing-off" the assembly. This may be achieved by rotating tubing of the assembly (such as drill tubing) and the motor body in a direction opposite to that required to make-up the assembly, by applying a torque lower than the torque required to make up the assembly.

Provision of the releasable joint, which releases at a torque significantly lower than the make-up torque may ensure that the releasable joint is released, rather than any of the joints between the assembly tubulars, or between the assembly tubing and the motor body. In this regard, it will be appreciated by persons skilled in the art that a drilling motor is typically run on lengths of drill tubing which are coupled together through standard, tapered, pin and box type connections.

Preferably, the joint comprises a male pin on an end of the motor shaft and a female box in the drill bit which together make up the releasable joint. It will be understood that this joint is of the "pin-down" type. The threads on the male pin and the female box forming the releasable joint may be configured to release at a lower torque than the make up torque. The releasable joint is preferably a substantially cylindrical threaded joint. Alternatively, the releasable joint may further comprise a coupling member such as a crossover having a male pin received in a female box on an end of the motor shaft, which together make-up the releasable joint. The crossover may also include a standard, tapered threaded pin for engaging a corresponding threaded box formed in the drill bit, for coupling the drill bit to the crossover. This may advantageously allow drill bits of standard types including tapered threaded joints to be employed in the drilling assembly. In a still further alternative, the releasable joint may comprise a coupling member such as crossover assembly having first and second bodies, one of the first and second bodies having a pin and the other of the first and second bodies having a box which, together, define the releasable joint. Each of the first and second bodies may also have tapered threaded joints or the like such that one of the first and second bodies may be coupled to the motor shaft whilst the other of the first and second bodies may be coupled to the drill bit by the tapered threaded joint. Thus, it will be understood that the releasable joint is provided as part of the crossover. This is particularly advantageous in that provision of such a crossover allows motor drive shafts and drill bits to be used having standard type tapered threaded joints.

Preferably, the locking means comprises locking members adapted to engage at least a part of the motor, to lock the motor shaft relative to the body of the motor. The locking members may be placed in a string of the assembly tubing at surface and be allowed to fall or be pumped down the string to the motor. The locking member may comprise locking balls. The motor may be shaped at an end thereof which is upstream in use or uppermost thereof, to define one or more spaces for receiving the locking members. It will be understood that when the locking members are received in the space, the motor shaft is locked. Alternatively, any other suitable locking means or method for locking the drive shaft relative to the body of the motor may be provided, such as flow rate string rotation pulling or setting weight down on the assembly, for example, to sheer locating pins for the shaft causing the shaft to be moved axially and locked.

According to a fourth aspect of the present invention, there is provided a method of selectively releasing a drill bit of a downhole drilling assembly from a remainder of the assembly, the method comprising the steps of:

providing the drilling assembly with a selectively releasable joint between a drilling motor of the assembly and the drill bit, and a locking means for locking a rotatable drill bit drive shaft of the drilling motor relative to a body of the motor;

activating the locking means to lock the motor shaft against rotation with respect to the motor body;

applying a rotational release force through tubing of the assembly and the motor body to release the releasable joint and separate the drilling motor from the drill bit; and recovering the remainder of the drilling assembly to surface.

Advantageously, this may allow the remainder of the drilling assembly to be retrieved in the event of the drill bit becoming stuck during a downhole drilling operation.

The method may further comprise the step of providing the selectively releasable joint between the drive shaft of the drilling motor and the drill bit.

The step of activating the locking means may comprise the step of providing locking members and passing the locking members down through the assembly tubing and into a part of the motor, to cause the drive shaft of the motor to lock relative to the motor body. The locking members may be inserted into the assembly tubing at surface and dropped or pumped through the tubing to the motor.

The step of applying a rotational release force may comprise the step of applying a release torque to generate the release force, and the release torque may be less than the torque required to make-up the drilling assembly. The release torque may be in the range of 30-50% of the make-up torque, and in particular may be approximately 40% of the make-up torque.

BRIEF DESCRIPTION OF THE DRAWING FIGURES

There follows a description of embodiments of the present invention, by way of example only, with reference to the accompanying drawings, in which.

DETAILED DESCRIPTION OF THE PREFERRED EMBODIMENTS

Figure 1C:
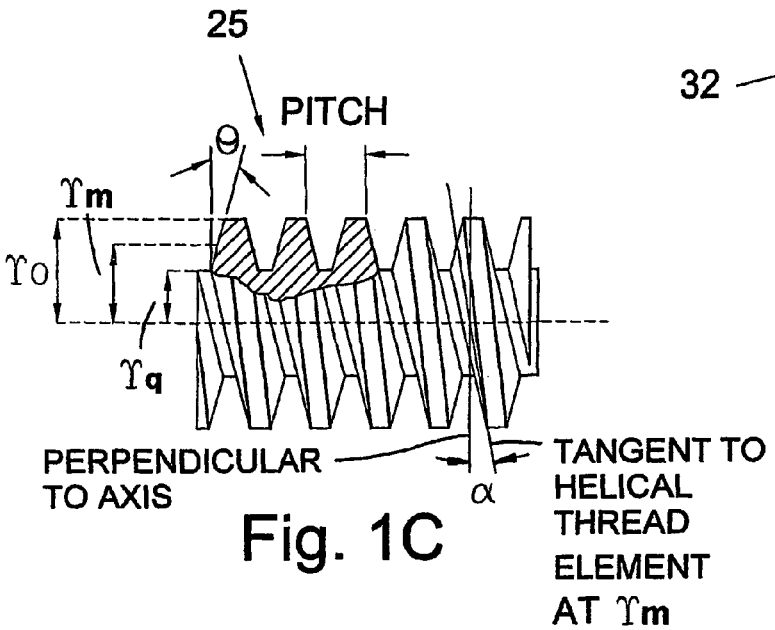
FIG. 1C is a longitudinal, partial cross-sectional view of part of a typical threaded joint.
Figure 1B:
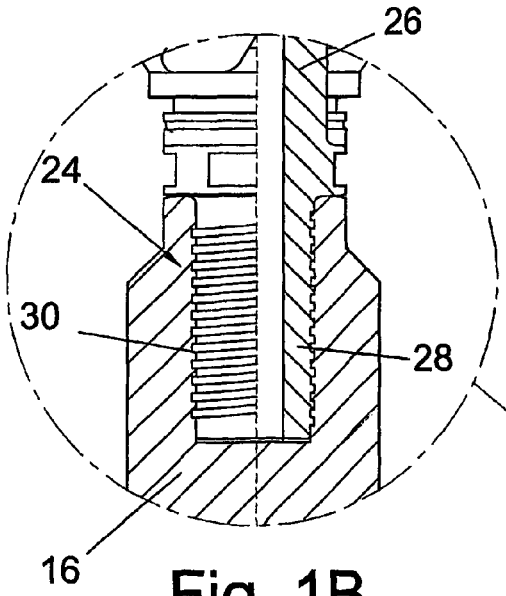
FIG. 1B is an enlarged view of a joint part forming a selectively releasable joint of the downhole drilling assembly of FIG. 1A.
Figure 1A:
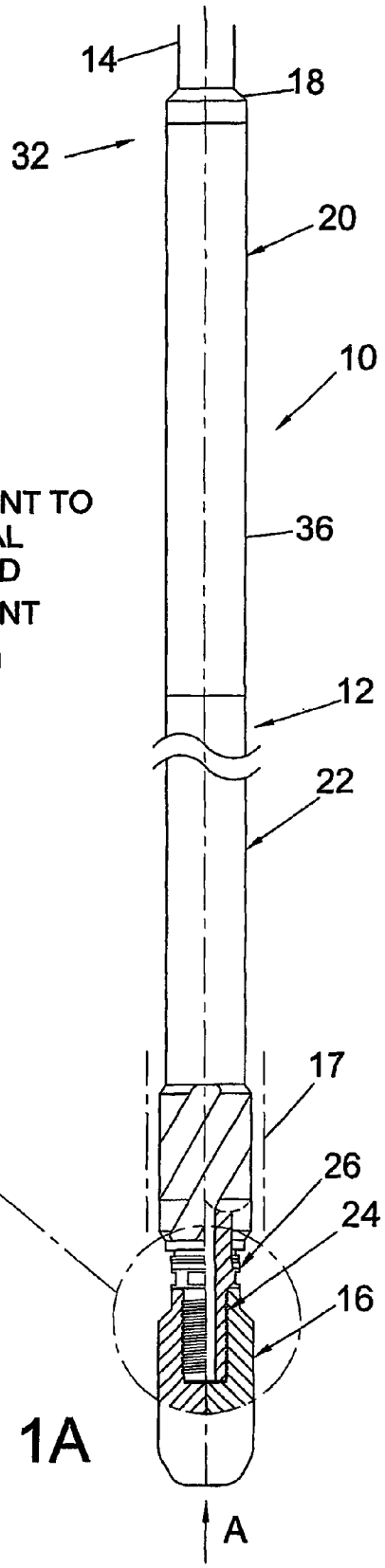
FIG. 1A is a longitudinal, partial cross-sectional view of a downhole tool assembly, in the form of a downhole drilling assembly in accordance with a first embodiment of the present invention.

Referring initially to FIG. 1A, there is shown a longitudinal partial cross-sectional view of a downhole tool assembly, in the form of a downhole drilling assembly in accordance with a preferred embodiment of the present invention and indicated generally by reference numeral 10.

The downhole drilling assembly 10 shown includes a motor in the form of a turbine 12, coupled through drill tubing 14 to surface for driving a drill bit 16 to drill a wellbore 17. In general terms, the motor 12 defines a first body of the assembly in the form of motor body 36, and a second body of the assembly in the form of motor power output drive shaft 26, mounted for rotation relative to the motor body 36. A joint part in the form of a selectively releasable joint is formed between the drive shaft 26 and the drill bit 16, and locking means 34 are provided for locking the drive shaft 26 relative to the motor body 36, to prevent relative rotation therebetween, as will be described below.

In more detail, the motor 12 includes, from top to bottom, a tapered, pin-down, box-up connection 18 for coupling to a lower end of the drill tubing 14; a turbodrill power section comprising a turbine 20; a turbodrill bearing section 22 and a safety joint part in the form of a selectively releasable joint 24, for coupling the drill bit 16 to a power output drive shaft 26 of the turbine 20. It will be understood by persons skilled in the art that the drive shaft 26 extends from the turbine 20, through the turbodrill bearing section 22 to the drill bit 16, and that a drilling assembly in this form includes drill tubing 14 which is rotationally stationary during a drilling operation. Rotation of the drill bit 16 is effected by pumping drilling fluid, such as a drilling mud, through the tubing 14 to the motor 12 and through the turbine 20, to activate the turbine, rotating the drive shaft 26 and drill bit 16.

The selectively releasable joint 24 is shown in more detail in the enlarged view of FIG. 1B, and it will be seen that the joint 24 comprises a cylindrical threaded pin 28 formed on a lower end of the drive shaft 26, and a corresponding threaded box 30 formed in the drill bit 16 for receiving and engaging the pin 28 in a "pin-down" fashion, as shown. It will be understood that the threads on the pin 28 and box 30 are right-hand threads, such that the bit 16 is made-up to the drive shaft 26 by rotating the bit 16 relative to the shaft 26 in a clockwise direction, when viewing in the direction of the arrow A in FIG. 1A, up to a desired mating force, by applying a corresponding torque.

In the mechanics of screw threads, the effort required to raise a load is not the same as the effort required to lower a load. This also applies to a screwed joint in that the torque required to unscrew the joint is not the same as the torque applied to make-up the joint. In most typical joints, this difference is small and joints require approximately the same torque to unscrew or "break out".

Referring now to FIG. 1C, which is a longitudinal, partial cross-sectional view of part of a typical threaded joint 25, if the lead (the distance the screw would advance relative to, for example, a nut, in one rotation; for a single thread screw, lead is equal to pitch) of the thread is increased, the difference between the make up and break out torques increases. Therefore, a significantly lower break out torque can be achieved.

The selectively releasable joint 24 is configured such that the connection between the pin 28 and the box 30 by the threads thereon is released by applying a release force at a release torque less than the torque applied to make-up the bit 16 to the shaft 26.

This is achieved by configuring the threads on the pin 28 and box 30 of joint 24 such that:

$$1 < \frac{\text{joint coefficient of friction}}{\tan(\text{helix angle})} > 3$$

where the tangent of the helix angle ($\alpha$) is determined by:

$$\tan(\alpha) = \frac{\text{lead}}{2\Pi r_a}$$

$r_a$ being the mean radius. The helix angle and pitch (equal to lead for a single thread screw) is shown for the typical pin 25 in FIG. 1C. The joint coefficient of friction depends to a large extent upon the lubricant used in the joint between the threads of the pin 28 and box 30, the thread structure, and to a lesser extent, the pin 28/box 30 materials. The joint coefficient of friction for the joint 24 may typically be in the range of 0.08 to 0.3. The break-out torque is dependent upon the value of the ratio of the joint coefficient of friction to the tan (helix angle), such that the difference between the make-up torque and the break-out torque is greatest when the ratio is close to 1, and smallest close to 3. However, typically the ratio will be around 2 for the joint 24, and the break out torques will likely be in the range of 30-50% of make up torque.

Thus, it will be understood that configuring the joint 24 in this fashion provides a safety joint where drill string connections between lengths of drill tubing 14 forming the string are of the normal type and break out at a torque approximately the same as the make up torque; the joint 24 is made with a special long lead thread according to the above relationship and is made up to the same torque as the other joints between the drill tubing 14 of the string. However, when a reverse torque of in the range of 30-50% of the make up torque is applied to the string, the string will "back out" (release) at the joint 24. In the preferred embodiment shown in the drawings, a square profile thread is employed.

Figure 2B:
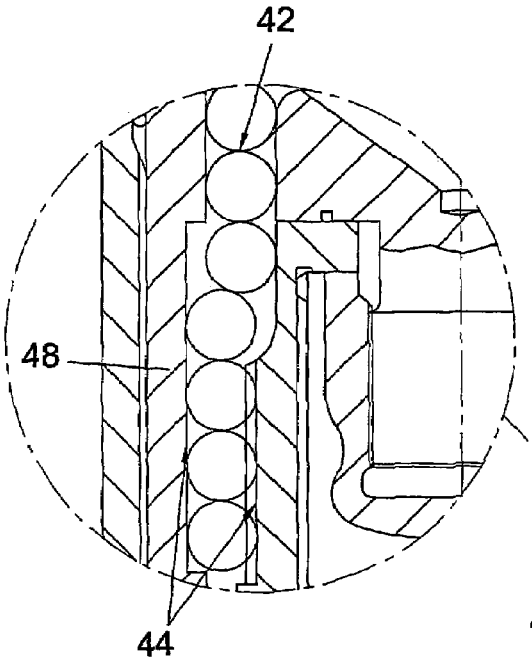
FIG. 2B is a further enlarged view of part of the motor of FIG. 2A, showing locking means of the drilling assembly in more detail.
Figure 2A:
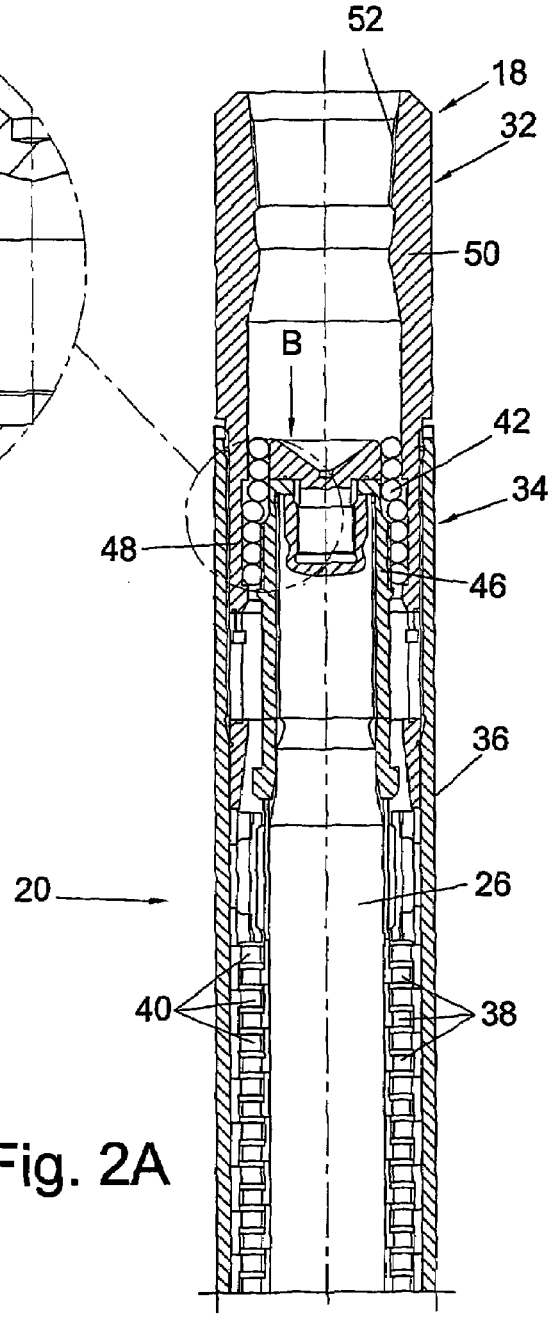
FIG. 2A is a longitudinal cross-sectional view of an upper part of a motor forming part of the downhole drilling assembly of FIG. 1A, drawn to a larger scale.

Turning now to FIG. 2A, there is shown a longitudinal cross-sectional view of an upper part 32 of the turbine 20 of the motor 12, which includes the connection 18 for connecting the motor 12 to the drill tubing 14. FIG. 2A shows in particular locking means in the form of a locking assembly 34 provided at an upper end of the drive shaft 26 of the turbine 20. It will be understood that the turbine 20 is generally of a type known in the art, where the drive shaft 26 acts as a rotor whilst a body 36 of the turbine 20 acts as a stator. Rotor blades 38 are provided spaced axially along the length of the drive shaft 26 and stator blades 40 are provided spaced along the length of the body 36. Drill fluid passing through the drill tubing 14 into the turbine 20 in the direction of the arrow B (shown in FIG. 2A) passes down between the rotor and stator blades 38, 40 to cause them to rotate relative to one another, thereby rotating the drive shaft 26 and drill bit 16.

Considering the locking assembly 34 in more detail, the assembly is shown in FIG. 2A where a number of locking members in the form of locking balls 42 have been inserted through the drill tubing 14 for locking the drive shaft 26 against rotation relative to the body 36 of the turbine 20. The locking balls 42 are shown in more detail in the enlarged view of FIG. 2B.

The locking assembly 34 further includes an asymmetrical space 44, formed between an outer surface of an upper end 46 of the drive shaft 26 and an inner surface of a lower end 48 of a sub 50, which defines a box connection 52 part of the coupling 18. The upper end 46 of the drive shaft 26 includes a number of flats (not shown), and when the locking balls 42 are located as shown in FIG. 2A, they lie in the space 44. By an interaction between the inner surface of lower end 48 of sub 50, the locking balls 42 and the flats on the shaft upper end 46, further rotation of the drive shaft 26 relative to the body 36 is prevented and the drive shaft 26 is therefore locked.

The operation of the drilling assembly 10 and the interaction between the various parts described above will become clear from the following description of the use of the assembly 10 in a well drilling operation.

The assembly 10 shown in FIG. 1A is made up at surface, and run to drill a wellbore 17, in a fashion apparent to the skilled person. During such drilling operations, the drill bit 16 occasionally becomes "stuck", such that further rotation and therefore deepening of the wellbore 17, is not possible. Furthermore, this jamming of the drill bit 16 causes the entire drilling assembly 10 to become stuck. When this situation occurs, the locking balls 42 are pumped down the drill tubing 14 from the surface, as described above, and are located in the space 44, thereby locking the drive shaft 26 against further rotation within and with respect to the body 36 of the turbine 20. This allows the releasable joint 24 to be "backed off", by applying a release torque through the drill tubing 14 and the motor body 36. This is achieved by rotating the assembly 10 in an anti-clockwise direction, when viewing in the direction of the arrow A in FIG. 1A, transmitting a release force to the releasable joint 24. As the releasable joint 24 of the assembly 10 releases at a release torque which is lower than the torque required to make-up the assembly, the drill bit 16 is released by a separation of the pin 28 from the box 30, allowing the remainder of the drilling assembly 10 to be recovered to surface. It is this provision of a joint which releases at a lower release torque which ensures that the assembly is released at a desired location, that is, at a location between the drill bit 16 and the drive shaft 26. This is advantageous in that it both allows the drilling assembly to be retrieved without having to abandon it in the wellbore, and furthermore allows the drill bit 16 to be recovered in a "fishing" operation (known in the art), such that the wellbore does not need to be sidetracked around the stuck drill bit 16.

Figure 3A:
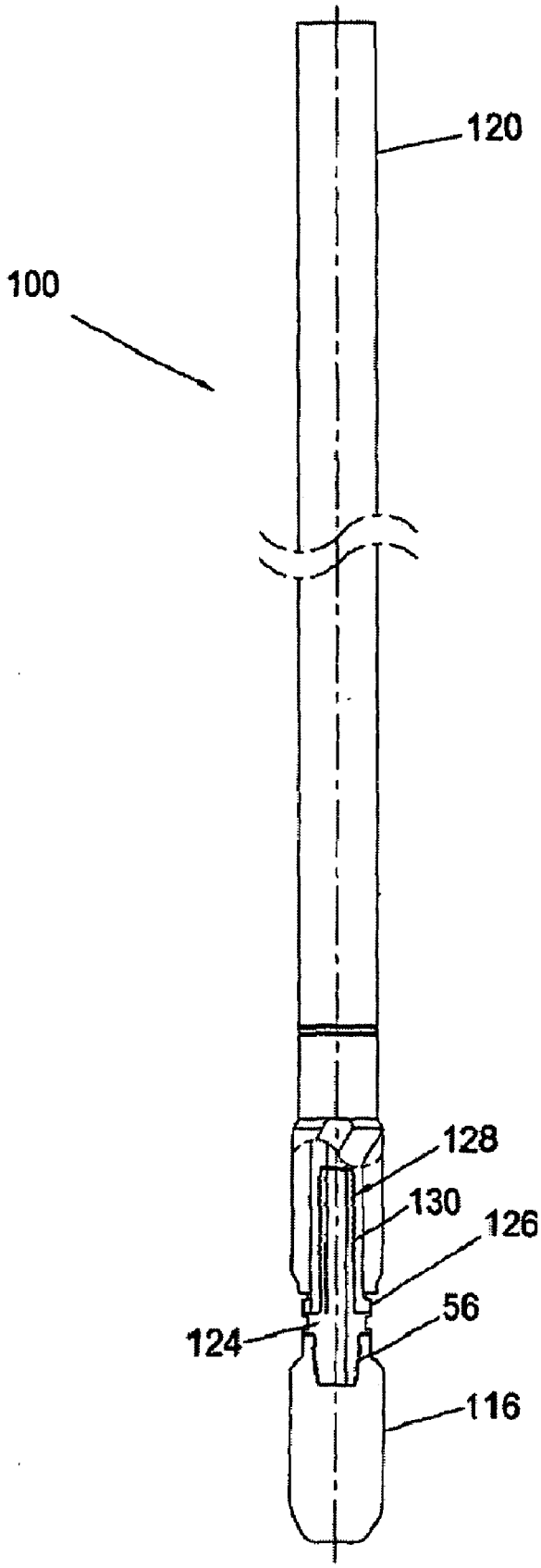
FIG. 3A is a longitudinal, partial cross-sectional view of a downhole tool assembly, in the form of a downhole drilling assembly in accordance with a second embodiment of the present invention.
Figure 3B:
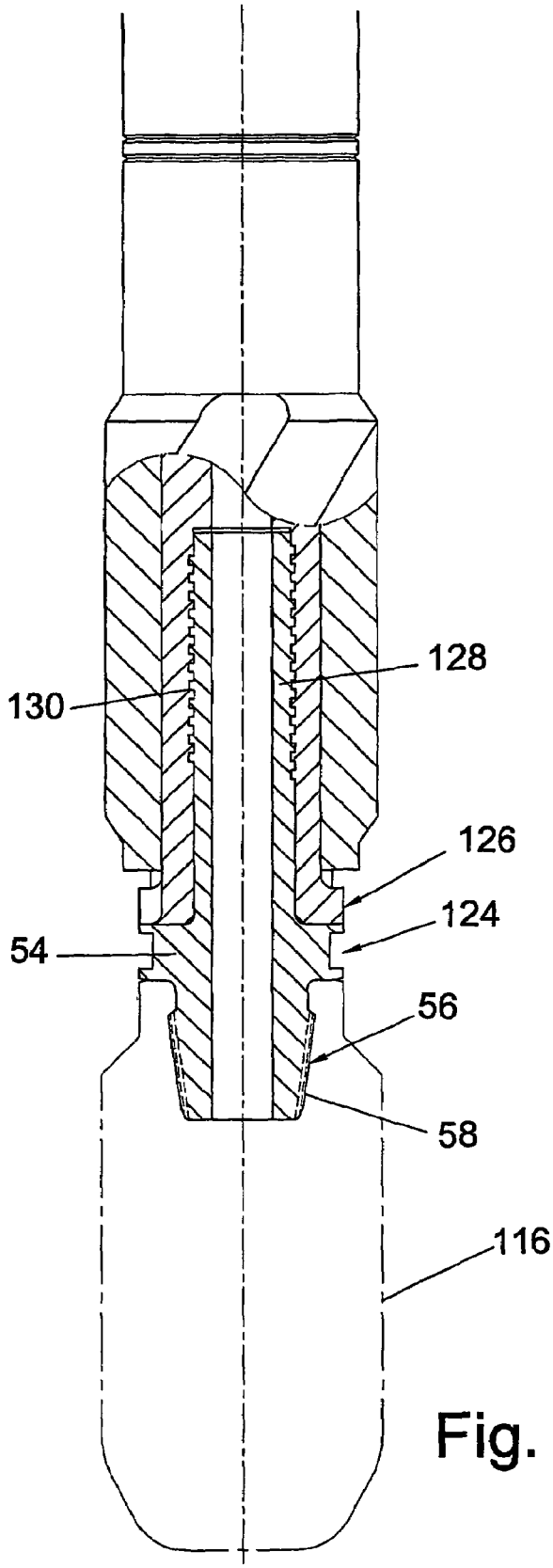
FIG. 3B is an enlarged view of a joint part forming a selectively releasable joint of the downhole drilling assembly of FIG. 3A.

Turning now to FIG. 3A, there is shown a longitudinal, partial cross-sectional view of a downhole drilling assembly in accordance with an alternative embodiment of the present invention, indicated generally by reference numeral 100. The drilling assembly 100 is substantially the same as the assembly 10 of FIG. 1A, and like components share the same reference numerals incremented by 100. In fact, the difference between the assemblies 10 and 100 is that the assembly 100 includes an alternative releasable joint 124. The joint 124 couples the drill bit 116 to the drive shaft 126 of turbine 120, and is shown in more detail in FIG. 3B, which is an enlarged view of the joint 124 of FIG. 3A. The joint 124 includes a crossover 54 and, instead of providing the turbine shaft with a pin-down connection, as in the assembly 10, the crossover includes a cylindrical threaded pin 128 which engages a box 130 formed in a lower end of the drive shaft 126 and which together form the releasable joint. Furthermore, the crossover 54 includes a tapered threaded pin 56 which engages a box 58 of bit 116, to form a standard tapered threaded pin and box connection between the bit 116 and the crossover 54. The particular advantage of this arrangement is that this allows drill bits (such as the bit 116) of a standard type to be employed, with a standard box connection 58, through the provision of the crossover 54. Of course, when the joint 124 is released in a fashion similar to that described above (by releasing the pin 128 from the box 130), both the bit 116 and the crossover 54 would be left in the wellbore, until such time as a fishing operation may be conducted to retrieve the bit and crossover.

Figure 4:
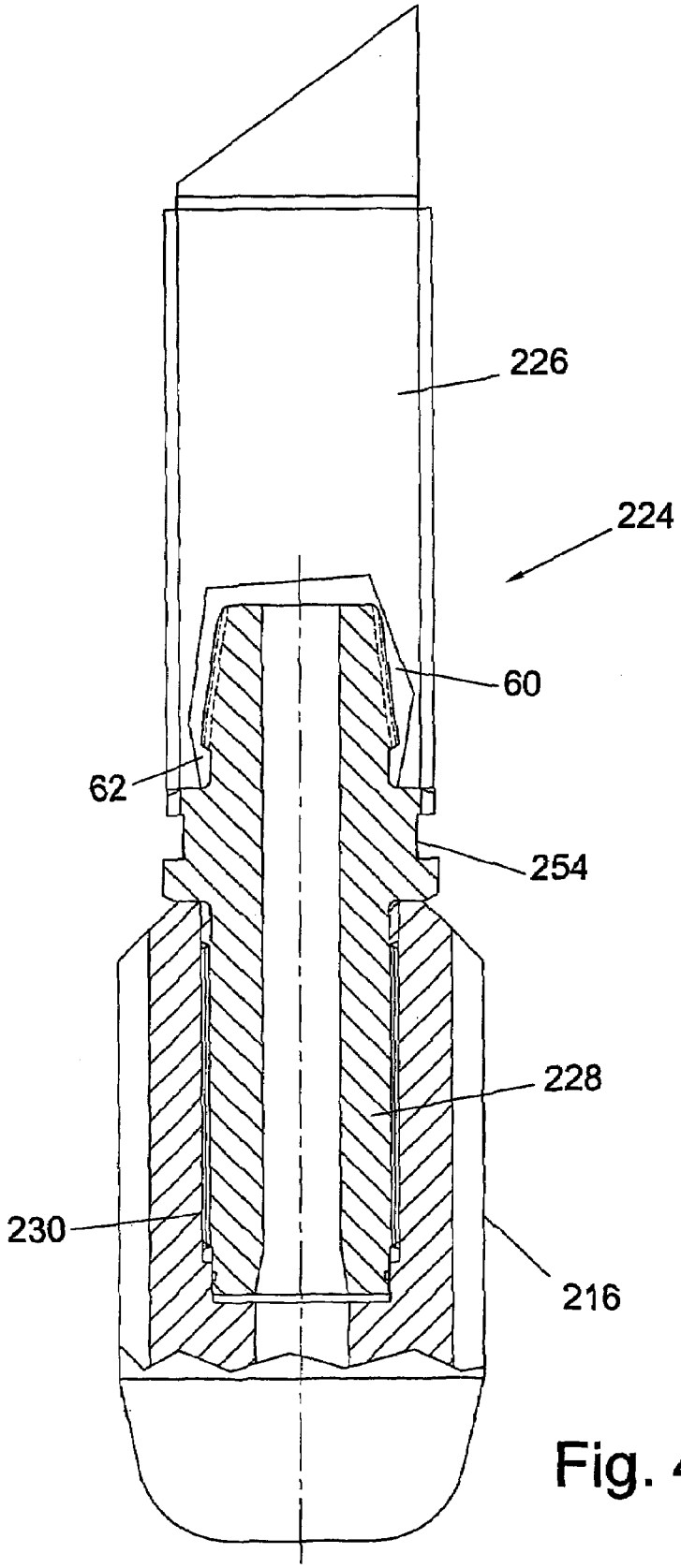
FIG. 4 is a view of part of a downhole drilling assembly in accordance with a third embodiment of the present invention, including a further alternative selectively releasable joint.

In FIG. 4, there is shown a part of a downhole drilling assembly in accordance with a further alternative embodiment of the present invention, including a further alternative selectively releasable joint, indicated generally by reference numeral 224. Like components with the assemblies 10 and 100 of FIGS. 1A and 3A share the same reference numerals incremented by 200. It will be understood that only part of an assembly incorporating the joint 224 is shown for clarity, as the remaining parts carrying the joint 224 are similar to those of FIGS. 1A and 3A.

The joint 224 includes a crossover 254 which includes a cylindrical threaded pin 228, coupled to a corresponding threaded box 230 in drill bit 216, to form the selectively releasable joint 224. The crossover 254 is coupled to a lower end of drive shaft 226 of a turbine (not shown) by a standard tapered threaded pin and box connection, which includes a pin 60 formed on the crossover 254 and a corresponding box 62 formed in the lower end of the drive shaft 226. It will be understood that this is advantageous in that the arrangement allows drilling motors such as turbines to be provided which have standard type drive shafts 266, carrying standard box connections, with the releasable joint formed between the crossover 254 and the bit 216.

Figure 5:
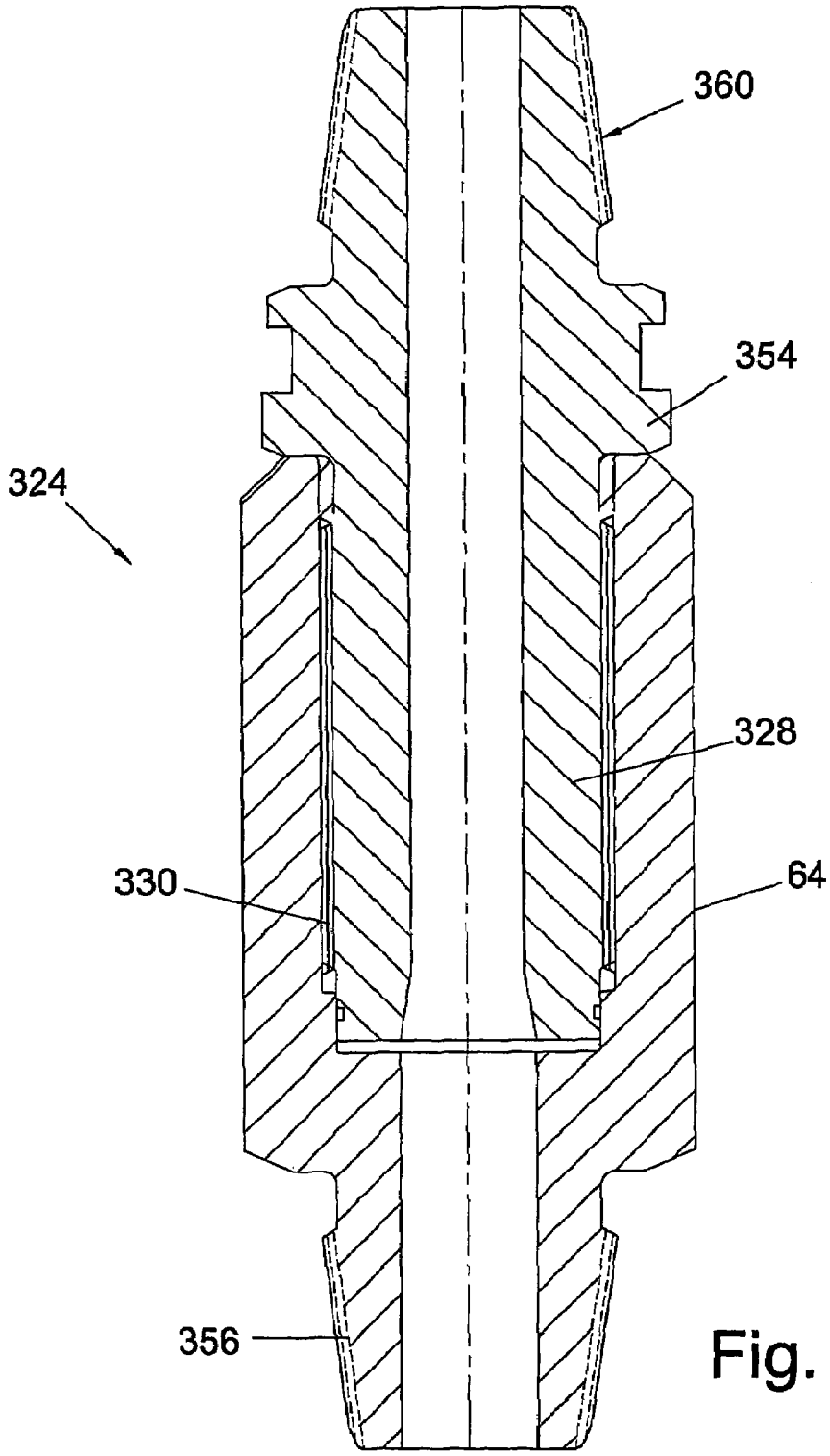
FIG. 5 is a view of a selectively releasable joint, forming part of a downhole drilling assembly in accordance with a fourth embodiment of the present invention.

FIG. 5 shows a still further alternative selectively releasable joint, indicated generally by reference numeral 324. Like components of the joint 324 with the assemblies of FIGS. 1A-4 share the same reference numerals incremented by 300. In a similar fashion to the joint 224 shown in FIG. 4, it will be understood that, for clarity, the remainder of a drilling assembly carrying the joint 324 is not shown.

The joint 324 comprises first and second bodies forming a crossover assembly and having a crossover 354 and a lower sub 64. The crossover 354 includes a tapered threaded pin 360 for connection to a drive shaft of a turbine (not shown), in a similar fashion to the crossover 254 of FIG. 4, and a cylindrical threaded pin 328 for engaging a corresponding threaded box 330 in the sub 64, to together define the releasable joint in the crossover assembly. The sub 64 also includes a tapered threaded pin 356 for engaging a corresponding box in a drill bit (not shown), in a similar fashion to the crossover 124 of FIG. 3A, which engages drill bit 116. The arrangement is particularly advantageous in that it both allows the use of standard turbine drive shafts and drill bits through standard tapered threaded pin and box connections. It will be understood that in the event of a drill bit coupled to a drive shaft through such a releasable joint 324 becoming struck, release of the drill bit is achieved by separating the pin 328 from the box 330 by applying a released torque in the fashion described above through the turbine drive shaft and the crossover 354.

It will be understood that references herein to a drilling motor and to a motor include any suitable device for generating a rotational drive force in a downhole environment, and include but are not limited to turbines, PDM's, electric motors and the like.

Various modifications may be made to the foregoing within the scope of the present invention. In particular, the joints 24, 124, 224, 324 may include threads of a modified square (5-10°) profile; however, other thread profiles may be employed with perhaps, less efficient operational characteristics. The downhole tool, although of particular benefit in the disclosed uses, may be used in any suitable downhole tool assembly where it is desired to release a part of the assembly in the event of the assembly becoming stuck as described above, and thus the downhole tool is not limited to use in a drilling assembly. It will be understood that the term "joint coefficient of friction" used herein is a term known in the art, as used, for example, by the American Petroleum Institute.

What is claimed is:

1. A downhole tool for use in a downhole tool assembly, the tool comprising:

a first body and a second body, the bodies being mounted for relative rotation;

a joint part adapted to form a selectively releasable joint between the second body and a part of the assembly couplable to the second body; and locking means for locking the first and second bodies relative to one another against relative rotation;

whereby, in use, locking said bodies relative to one another facilitates application of a release force through the first body to the releasable joint to release said joint so as to thereby separate the tool from said part of the assembly, wherein the joint comprises a threaded male pin and a co-operating threaded female box, and wherein the threads on the pin and box of the joint are configured such that:

$$1 < \frac{\text{joint coefficient of friction}}{\tan(\text{helix angle})} > 3$$

where the tangent of the helix angle ($\alpha$) is determined by:

$$\tan(\alpha) = \frac{\text{lead}}{2\Pi r_m}$$

where $r_m$ is the thread mean radius.

2. A downhole tool assembly, the assembly including a downhole tool, the tool comprising: a first body and a second body, the bodies being mounted for relative rotation; a joint part forming a selectively releasable joint between the second body and a part of the assembly coupled to the second body; and locking means for locking the first and second bodies relative to one another against relative rotation; whereby locking the bodies relative to one another facilitates application of a release force through the first body to the releasable joint to release the releasable joint to thereby separate the tool from the part of the assembly, wherein the selectively releasable joint is configured to release at a release force which is less than the force applied to make up the joint.

3. The downhole tool assembly as claimed in claim 2, wherein the downhole tool assembly comprises a downhole drilling assembly and the downhole tool includes a drilling motor for driving a drill bit of the assembly.

4. A downhole drilling assembly comprising: a drill bit; a downhole drilling motor having a motor body for coupling to tubing of the assembly and a rotatable drive shaft for coupling to the drill bit; a selectively releasable joint located between the drilling motor and the drill bit; and locking means for locking the drive shaft relative to the motor body; whereby locking the drive shaft relative to the motor body facilitates application of a release force through the assembly tubing and the motor body to the releasable joint to release the releasable joint to thereby separate the drill bit from a remainder of the drilling assembly, wherein the selectively releasable joint is configured to release at a release force which is less than the force applied to make up the joint for drilling operations.

5. The downhole drilling assembly as claimed in claim 4, wherein the selectively releasable joint is configured to release at a release torque lower than 70% of the torque required to make up the joint.

6. The downhole drilling assembly as claimed in claim 5, wherein the release torque is between 30-50% of the torque required to make up the joint.

7. The downhole drilling assembly as claimed in claim 4, wherein the selectively releasable joint is located between the drive shaft and the drill bit, to allow separation of the drill bit from the remainder of the drilling assembly at a location between the drill bit and the drive shaft.

8. The downhole drilling assembly as claimed in claim 4, wherein the joint comprises a threaded male pin and a co-operating threaded female box.

9. The downhole drilling assembly as claimed in claim 8, wherein the male pin is provided on an end of the drive shaft and the female box in the drill bit.

10. The downhole drilling assembly as claimed in claim 9, wherein threads on the male pin and the female box forming the releasable joint are configured to release at a lower torque than the make up torque.

11. The downhole drilling assembly as claimed in claim 8, wherein the releasable joint further comprises a coupling member, one of the coupling member and the drive shaft defining the male pin and the other one of the coupling member and the drive shaft defining the female box.

12. The downhole drilling assembly as claimed in claim 11, wherein the coupling member includes a male pin for engaging a corresponding female box formed in the drill bit, for coupling the drill bit to the coupling member.

13. A downhole drilling assembly as claimed in claim 8, wherein the releasable joint further comprises a coupling assembly having first and second bodies, one of the first and second bodies defining the pin and the other of the first and second bodies defining the box.

14. The downhole drilling assembly as claimed in claim 13, wherein each of the first and second bodies have standard tapered threaded joints for coupling one of the first and second bodies to the drive shaft, and the other of the first and second bodies to the drill bit.

15. The downhole drilling assembly as claimed in claim 4, wherein the releasable joint is a substantially cylindrical threaded joint.

16. The downhole drilling assembly as claimed in claim 4, wherein the locking means comprises locking members adapted to engage at least a part of the motor, to lock the drive shaft relative to the body of the motor.

17. The downhole drilling assembly as claimed in claim 16, wherein the locking members are placed in a string of the assembly tubing at surface for transportation down the string to the motor.

18. The downhole drilling assembly as claimed in claim 16, wherein the locking members comprise locking balls.

19. The downhole drilling assembly as claimed in claim 16, wherein the motor is shaped at an end thereof which is upstream in use to define at least one space for receiving the locking members.

20. The downhole drilling assembly as claimed in claim 4, wherein the drilling motor comprises a fluid driven turbine.

21. The downhole drilling assembly as claimed in claim 4, wherein the drilling motor comprises a positive displacement motor.

22. A method of selectively releasing a drill bit of a downhole drilling assembly from a remainder of the assembly, the method comprising the steps of: providing the drilling assembly with a selectively releasable joint between a drilling motor of the assembly and the drill bit, and a locking means for locking a rotatable drill bit drive shaft of the drilling motor relative to a body of the motor; activating the locking means to lock the drive shaft against rotation with respect to the motor body; applying a rotational release force through tubing of the assembly and the motor body to release the releasable joint and separate the drilling motor from the drill bit; and recovering the remainder of the drilling assembly to surface, wherein the step of applying a rotational release force further comprises applying a release torque to generate the release force, and wherein the release torque is less than the torque required to make up the drilling assembly.

23. The method as claimed in claim 22, wherein the applied release torque is between 30-50% of the make up torque.

24. The method as claimed in claim 22, further comprising providing the selectively releasable joint between the drive shaft and the drill bit.

25. The method as claimed in claim 22, wherein the step of activating the locking means further comprises passing locking members down through the assembly tubing and into a part of the motor, to cause the drive shaft to lock relative to the motor body.

26. The method as claimed in claim 25, wherein the locking members are inserted into the assembly tubing at surface and transported through the tubing to the motor.

* * * * *